US005734395A

United States Patent [19]

Kamisuki et al.

[11] Patent Number: 5,734,395

[45] Date of Patent: Mar. 31, 1998

[54] INK JET HEAD

[75] Inventors: Shinichi Kamisuki; Mitsuro Atobe; Hiroshi Koeda; Shinichi Yotsuya; Masahiro Fujii; Naoki Kobayashi, all of Suwa, Japan

[73] Assignee: Seiko Epson Corporation, Tokyo, Japan

[21] Appl. No.: 481,528

[22] PCT Filed: Dec. 21, 1993

[86] PCT No.: PCT/JP93/01849

§ 371 Date: Sep. 11, 1995

§ 102(e) Date: Sep. 11, 1995

[87] PCT Pub. No.: WO94/15791

PCT Pub. Date: Jul. 21, 1994

[30] Foreign Application Priority Data

Jan. 6, 1993 [JP] Japan ..... 5-000664

[51] Int. Cl.[6] ..... B41J 2/05

[52] U.S. Cl. ..... 347/54; 347/59; 437/51

[58] Field of Search ..... 347/54, 59; 437/51

[56] References Cited

U.S. PATENT DOCUMENTS

| | | | |
|---|---|---|---|
| 5,081,474 | 1/1992 | Shibata et al. | 346/140 |
| 5,534,900 | 7/1996 | Ohno et al. | 347/54 |

FOREIGN PATENT DOCUMENTS

| | | |
|---|---|---|
| A-0 479 441 | 4/1992 | European Pat. Off. . |
| 3-23950 | 1/1991 | Japan . |
| 3-288649 | 12/1991 | Japan . |
| 3-295654 | 12/1991 | Japan . |

*Primary Examiner*—Daniel P. Malley

*Attorney, Agent, or Firm*—Mark P. Watson

[57] ABSTRACT

An ink jet head includes a common electrode formed on a semiconductor substrate. A charge is applied to the common electrode and an electrode disposed on another substrate in opposition to a diaphragm formed in the semiconductor substrate to electrostatically deform the diaphragm and eject ink. The common electrode comprises a single layer or multiple layer metallic coating forming ohmic contact on the semiconductor substrate. In addition, a group III or group V element is doped to a high concentration at the area on the semiconductor substrate where the common electrode is formed. The diaphragm can therefore vibrate at high speed. An ink jet head capable of high speed printing can be provided because supply and elimination of the charge to the diaphragm can be accomplished at high speed.

15 Claims, 17 Drawing Sheets

INK JET HEAD

BACKGROUND OF THE INVENTION

1. Field of the Invention

The present invention relates to an ink jet head that is the main component of an ink jet recording apparatus, and relates particularly to a compact, high density ink jet head using electrostatic power as the drive power therefor.

2. Description of the Related Art

Ink jet recording apparatuses offer numerous benefits, including extremely quiet operation during recording, a high speed printing capability, and the ability to use low-cost plain paper. The so-called "ink-on-demand" drive method whereby ink is output only when required for recording is now the mainstream in such recording apparatuses because it is not necessary to recover ink not used for recording.

The ink jet heads used in this ink-on-demand method commonly use a piezoelectric device for the drive means as described in JP-B-51734/1990, or eject the ink by means of pressure generated by heating the ink to generate bubbles as described in JP-B-59911/1986; it is primarily these two methods that are practical today, and are used in many ink jet printers.

However, in the former method using a piezoelectric device, the process of bonding the piezoelectric chip to the diaphragms used to produce pressure in the pressure chamber is complicated. With current ink jet recording apparatuses having plural nozzles and a high nozzle density to meet the demand for high speed, high quality printing, these piezoelectric devices must be precisely manufactured and bonded to the diaphragms, processes that are extremely complicated. As the nozzle density has increased, it has become necessary to process the piezoelectric devices to a width of several ten to one hundred and several ten microns. With the dimensional and shape precision achievable using current machining processes, however, the ejection characteristics of the nozzles is inconsistent and there is a wide variation in print quality; this method is particularly unsuitable as a means of providing a high density ink jet head at low cost.

In the latter method in which the ink is heated, the above problems do not exist because the drive means is formed by means of a thin-film resistive heater. The resistive heater does become damaged over time, however, by the repeated rapid heating and cooling of the drive means and the impact of bubble dissipation, and the practical service life of the ink jet head is accordingly short.

As another effective drive means solving these problems, an ink jet head using electrostatic force as the drive power has been proposed in U.S. Pat. No. 4,520,375 and JP-A-289351/1990; in this ink jet head, a silicon (Si) substrate is etched; a diaphragm and pressure chamber are integrally formed on the silicon substrate; a conductive substrate is formed in opposition to the back of the pressure chamber with a gap therebetween; the gap between the diaphragm and conductive substrate is repeatedly charged and discharged to produce an electrostatic force therein that causes the diaphragm to vibrate; and ink is thus ejected from the nozzle by the pressure change produced in the pressure chamber. These methods using electrostatic force as the drive power have at present not reached the point of practical application as an actuator for ink jet printers, but with recent advances in micromachining techniques have gained significant reliability as micropumps implanted in the body for the administration of drugs (insulin); when applied as an actuator for an ink jet printer to take advantage of such features as the precise, simple construction and long-term reliability, benefits such as a compact, high density package and long service life will be obtained.

However, if a method using electrostatic force as the drive power is to be applied as the actuator of an ink jet printer, it must be possible to drive the actuator at the power supply voltage commonly used for printers, i.e., information devices, and it must be possible to achieve high speed printing, i.e., operation driven by a high frequency must be possible; U.S. Pat. No. 4,520,375 and JP-A-289351/1990, however, do not go so far as to teach the structure of a practical ink jet head meeting these requirements.

More specifically, with respect to the above requirements, the silicon substrate itself is the structure of the ink jet head and functions as the path of electrical current flow to the diaphragm in U.S. Pat. No. 4,520,375. Silicon is, however, a semiconductor with a certain electrical resistance, and a so-called rectifying contact state is easily formed particularly at the contact with the drive circuit. This rectifying contact area functions as a diode, and is therefore not desirable for ink jet head drive because charge movement is restricted to a single direction; this is particularly fatal with respect to high speed printing. The high electrical resistance of the silicon becomes a factor inhibiting high speed drive because the time constant during drive is increased by the high resistance. Furthermore, a severe problem occurs in high density heads; specifically, the cross sectional area of the silicon substrate itself decreases in relative terms, and the resistivity accordingly increases.

On the other hand, JP-A-289351/1990 differs from U.S. Pat. No. 4,520,375 in that the ink path and diaphragms are formed in the silicon substrate, individual electrodes are formed on the diaphragms on the other side of the ink path, and the silicon is itself not used as the path of electrical current flow. While the electrical characteristics of the silicon itself therefore does not become a factor inhibiting high speed drive of the ink jet head, the following considerations do become factors inhibiting high speed operation.

Specifically, if the electrode gap between the individual electrodes on the diaphragms and the opposing common electrode becomes small, dielectric breakdown between the electrodes occurs as a result of electrode contact; it is therefore necessary to make the electrode gap sufficiently great to prevent contact between the individual electrodes and the common electrode, but if the electrode gap is too large, an extremely high voltage is required to deform the diaphragm enough to eject ink, and drive at the power supply voltage commonly used for printers is impossible. The specification of JP-A-289351/1990 addresses this problem by filling the electrode gap with a ferroelectric substance to improve the electrostatic force, but such ferroelectric materials have a fixed crystal orientation, i.e., a high dielectric constant is obtained in a solid phase, and in practice vibration sufficient to eject ink is not obtained. In addition, the electrode gap must be reduced with dielectric fluids because a sufficient dielectric constant cannot be obtained; as a result, the viscous resistance of the dielectric fluid becomes extremely high, the frequency response of the diaphragm drops significantly, drive at a frequency that is practical for the head of an ink jet printer becomes difficult, and for the aforementioned reasons such a head has not been achieved.

Therefore, an object of the present invention is to resolve the aforementioned problems in an ink jet head using electrostatic force as the drive source, and to provide a more practical ink jet head whereby:

1) drive at a low power supply voltage commonly used for printers is possible;
2) high speed printing is achieved, i.e., drive at a high frequency is possible; and
3) low voltage, high speed drive is also possible in a high density head.

SUMMARY OF THE INVENTION

An ink jet head of this invention comprises a semiconductor substrate, which integrates part of the ejection chambers in communication with nozzles and diaphragms disposed in a part of said ejection chambers. The semiconductor substrate is laminated to a substrate forming individual electrodes in opposition to said diaphragms with a gap therebetween.

The invention is characterized by forming, on all or part of the semiconductor substrate surface not including the area in opposition to the electrodes, a metallic coating in plural layers comprising a first layer of chrome (Cr) or titanium (Ti), and a second layer of gold (Au), rhodium (Rh), or platinum (Pt), or by forming a single layer metallic coating of aluminum (Al), tin (Sn), or indium (In).

A drive circuit is connected to the metallic coating layer and the electrodes for driving an ink jet head. An electrical pulse is applied between the metallic coating layer on the semiconductor substrate and the individual electrodes to generate an electrostatic force deflecting the diaphragms to eject ink.

A charge can travel smoothly in the contact area because the contact area of the metallic coating layer and semiconductor substrate can be formed with low resistance (ohmic contact) irrespective of the polarity of the voltage applied to the metallic coating. Therefore low voltage drive is possible because the ohmic loss is low and efficiency is high and high speed drive of the ink jet head is possible because the time constant during driving can be reduced. The invention is also effective for achieving a high nozzle density.

In addition, the contact area of the metallic coating layer and the semiconductor substrate can be formed with even lower resistance by doping a group III element to at least that part of the semiconductor substrate surface where the metallic coating is formed when the semiconductor substrate is a p-type semiconductor, and by doping a group V element to at least that part of the semiconductor substrate surface where the metallic coating is formed when the semi conductor substrate is an n-type semiconductor.

It is further possible to equalize the resistances each defined by a length between the drive circuit and the each diaphragm, and to reduce the variation in ejection characteristics between nozzles, by forming the metallic coating equidistant to all diaphragms on the semiconductor substrate.

Furthermore, an increase in the time constant, which is determined from the capacitance of the capacitor consisting of the diaphragm and the electrode and the resistance of the semiconductor substrate, is avoided by setting the resistivity of the semiconductor substrate to 20½-cm or less.

Therefore deterioration of the ink ejection characteristics resulting from the diaphragms not being pulled sufficiently to the individual electrodes when the time constant increases is prevented.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
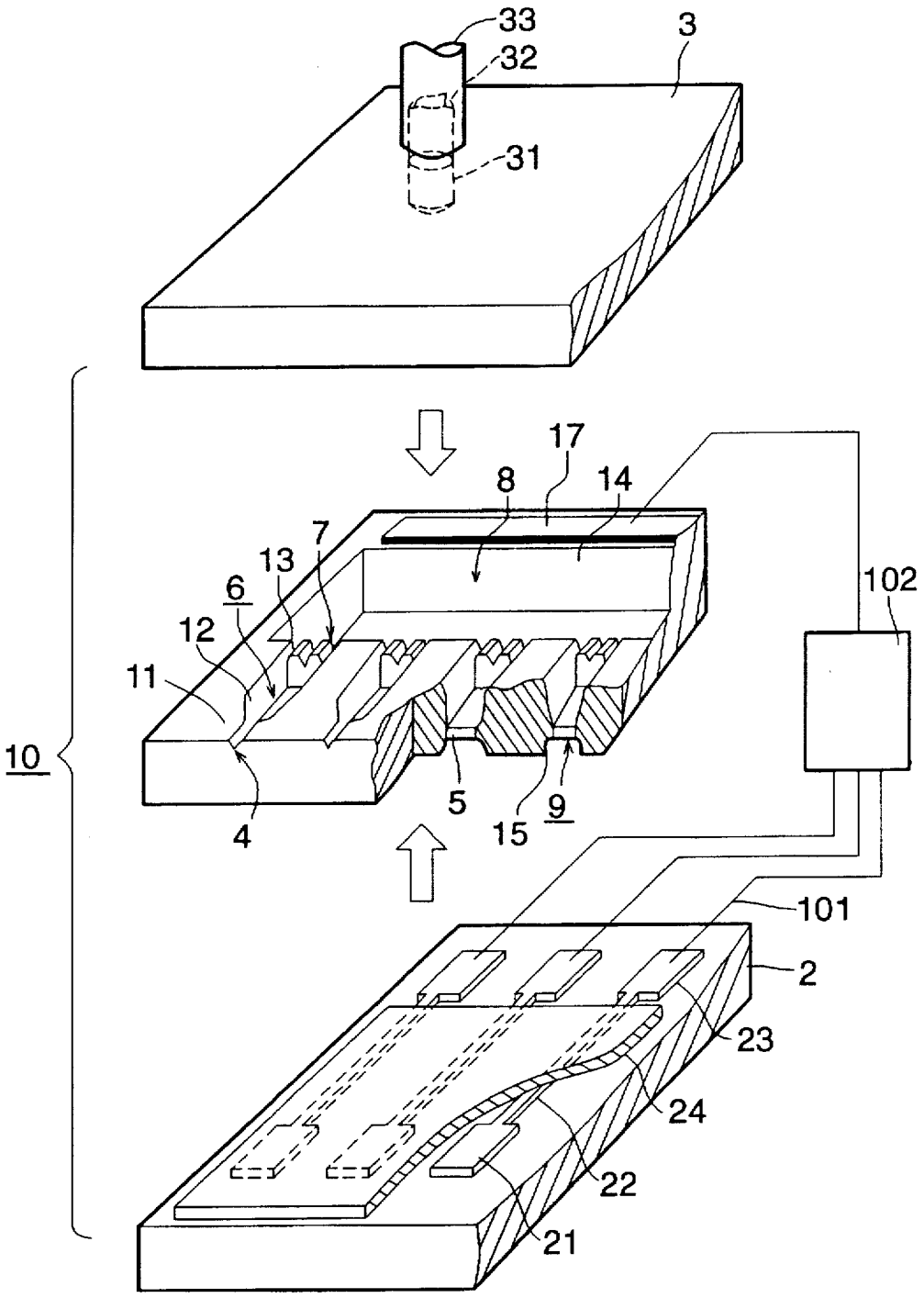
FIG. 1 is a partially exploded perspective view of an ink jet head according to one embodiment of the present invention.
Figure 2:
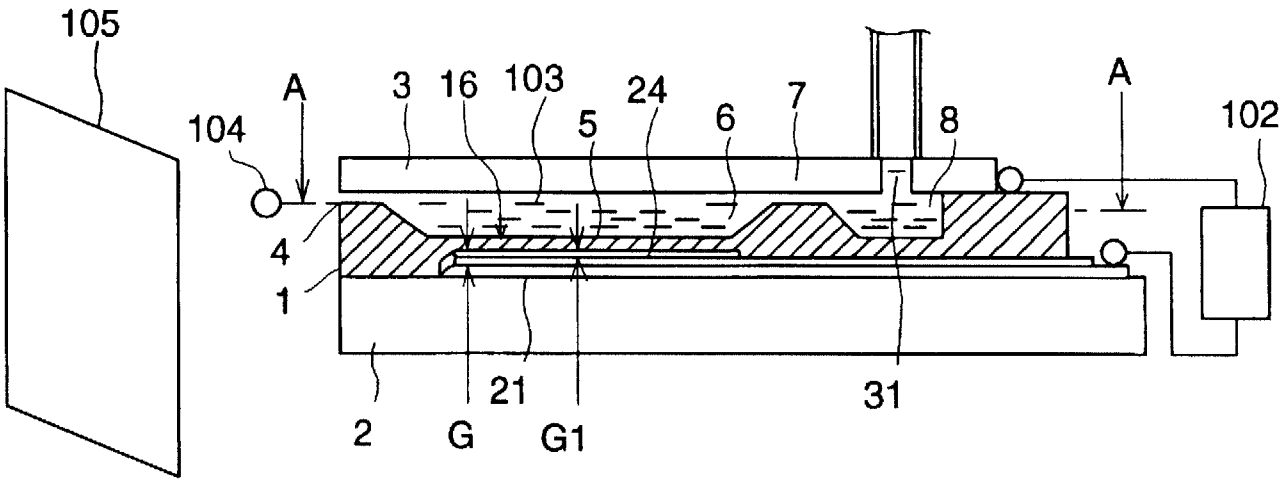
FIG. 2 is a side cross section of the complete ink jet head shown in FIG. 1.
Figure 3:
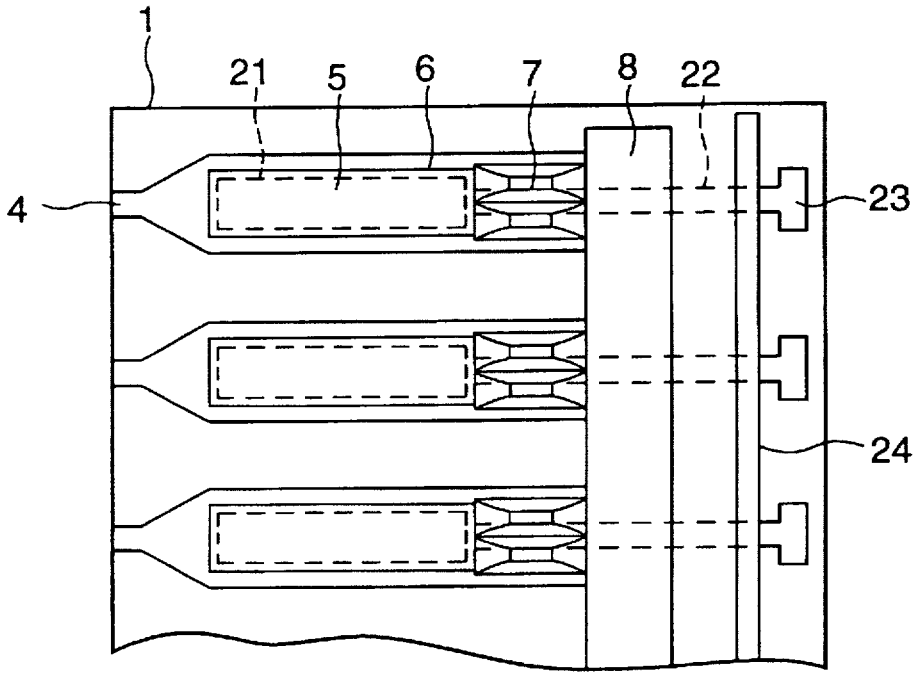
FIG. 3 is a view at line A—A in FIG. 2.

FIG. 1 is a partially exploded perspective view of an ink jet head according to a first embodiment of the present invention. Note that while this embodiment is shown as an edge ejection type whereby ink droplets are ejected from nozzles provided at the edge of the substrate, the invention may also be applied with a face ejection type whereby the ink is ejected from nozzles provided on the top surface of the substrate. FIG. 2 is a side cross section of the complete assembled ink jet head, and FIG. 3 is a view at line A—A in FIG. 2. The ink jet head 10 in this embodiment is a laminated construction of three substrates 1, 2, 3 structured as described in detail below.

The first substrate 1 is a silicon wafer and comprises plural nozzles 4 including plural parallel nozzle channels 11 formed on the surface of first substrate 1 at equal intervals from one edge of substrate 1; recesses 12 continuous to the respective nozzle channel 11 and forming ejection chambers 6, of which the bottom is diaphragm 5; narrow channels 13 functioning as the ink inlets and forming orifices 7 provided at the back of recesses 12; and recess 14 forming common ink cavity 8 for supplying ink to each ejection chamber 6.

Recesses 15 forming vibration chambers 9 for placement of the electrodes described below are provided below diaphragm 5.

In this embodiment, a gap holding means is formed by vibration chamber recesses 15 formed in the bottom surface of the first substrate 1 such that the gap between diaphragm 5 and the individual electrode disposed opposite thereto, i.e., length G (see FIG. 3; hereinafter the "gap length") of gap portion 16, is equal to the difference between the depth of recess 15 and the thickness of the electrode. In this embodiment, the depth of recess 15 is 0.6 μm. It is to be noted that the pitch of nozzle channels 11 is 0.72 mm, and the width is 70 μm.

Common electrode 17 is also formed on the first substrate 1 from a multiple layer metallic coating comprising a Cr or Ti first layer and a Au, Rh, or Pt second layer, or from a single layer metallic coating of Al, Sn, or In.

Borosilicate glass is used for second substrate 2 bonded to the bottom surface of first substrate 1; this bonding of second substrate 2 forms vibration chamber 9. Individual electrodes 21 are formed by sputtering gold on second substrate 2 at positions corresponding to diaphragm 5 to a 0.1 μm thickness in a pattern essentially matching the shape of diaphragms 5. Each individual electrode 21 comprises a lead member 22 and a terminal member 23. A Pyrex sputter film is formed on the entire surface of second substrate 2 except for terminal members 23 to a 0.2 μm thickness to form insulation layer 24, thus forming a coating for preventing dielectric breakdown and shorting during ink jet head drive.

Insulation layer 24 is not necessarily provided on individual electrodes 21, and a silicon dioxide ($SiO_2$) film may be formed on the entire surface of first substrate 1 as an insulation film, for example. In this case, the contact area becomes a MOS structure and a capacitor is formed if the oxide film is formed in the area of the common electrode, and it is therefore preferable to not form the oxide layer in the area of the common electrode.

In addition, vibration chambers 9 disposed in first substrate 1 are not necessarily formed in first substrate 1, and as will be described below (FIG. 8), it is possible to eliminate vibration chambers 9 disposed in first substrate 1 and form recessed members to a predetermined depth in the second substrate side to dispose the vibration chambers.

The top third substrate 3 bonded to the top surface of first substrate 1 uses borosilicate glass, the same as second substrate 2. By this bonding of third substrate 3, nozzles 4, ejection chamber 6, orifices 7, and ink cavity 8 are formed. Ink supply port 31 is also formed in third substrate 3 continuous to ink cavity 8. Ink supply port 31 is connected to an ink tank (not shown in the figure) using connector pipe 32 and tube 33.

First substrate 1 and second substrate 2 are anodically bonded at 300°~500° C. by applying a 500~800-V charge, and first substrate 1 and third substrate 3 are bonded under the same conditions to assemble the ink jet head as shown in FIG. 3. After anodic bonding, gap length G formed between diaphragms 5 and individual electrodes 21 on second substrate 2 is the difference between the depth of recess 15 and the thickness of individual electrodes 21, and is 0.5 μm in this embodiment. Gap G1 between diaphragms 5 and insulation layer 24 covering individual electrodes 21 is 0.3 μm.

After thus assembling the ink jet head, drive circuit 102 is connected by leads 101 between common electrode 17 and terminal members 23 of individual electrodes 21, thus forming an ink jet printer. These electrical connections between electrodes 17 and 23 and leads 101 are accomplished by brazing, by forming an anistropic conductive film and connecting by thermocompression bonding, by connecting with a conductive adhesive, or other method. Of these methods, connection by brazing is preferable with respect to mechanical strength and lowering the contact resistance, but a method using an anistropic conductive film is most preferable with respect to reducing the size and increasing the density and number of nozzles in the head. Ink 103 is supplied from the ink tank (not shown in the figures) through ink supply port 31 into first substrate 1 to fill ink cavity 8 and ejection chambers 6. The ink in ejection chamber 6 becomes ink drop 104 ejected from nozzles 4 and printed to recording paper 105 when ink jet head 10 is driven.

The electrical connections of an ink jet head as described above are described next.

For the semiconductor and metal in the area of the electrode contact at the boundary surface, a state in which the electrical resistance differs according to the polarity of the voltage applied to the contact area, i.e., a rectifying contact (diode), is formed depending upon the type of the semiconductor and metal.

Whether a rectifying contact or ohmic contact, in which the electrical resistance does not differ according to the polarity of the voltage applied to the contact, is formed in the contact area is influenced by the size relationship of the work functions of the metal and semiconductor. In case where the semiconductor substrate is a p-type semiconductor, there is a tendency for an ohmic contact to be formed in the contact area when the work function of the metal is greater than the work function of the semiconductor, and a tendency for a rectifying contact to be formed when the opposite is true. N-type semiconductors are known to exhibit properties opposite those of p-type semiconductors.

Figure 4:
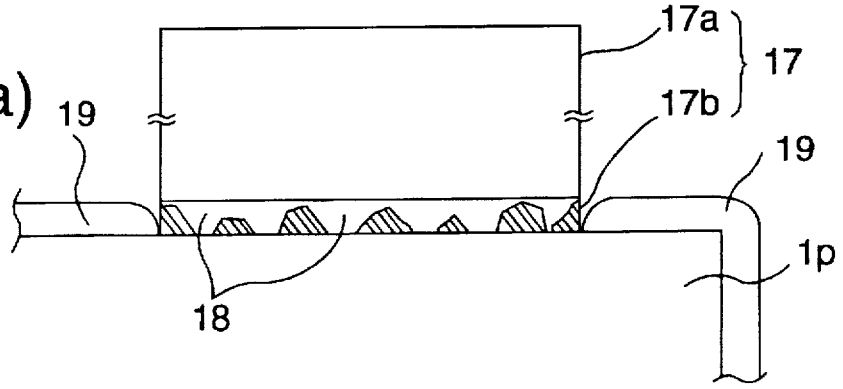
FIGS. 4(*a*)–4(*c*) show a detailed partial cross section of the common electrode area in the above embodiment.
Figure 4:
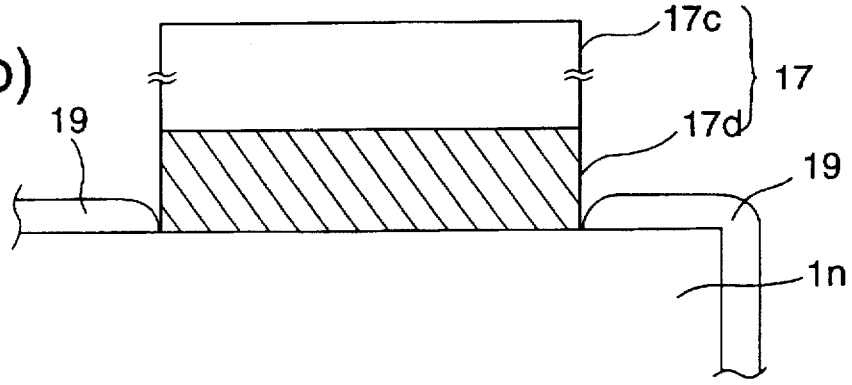
Figure 4:
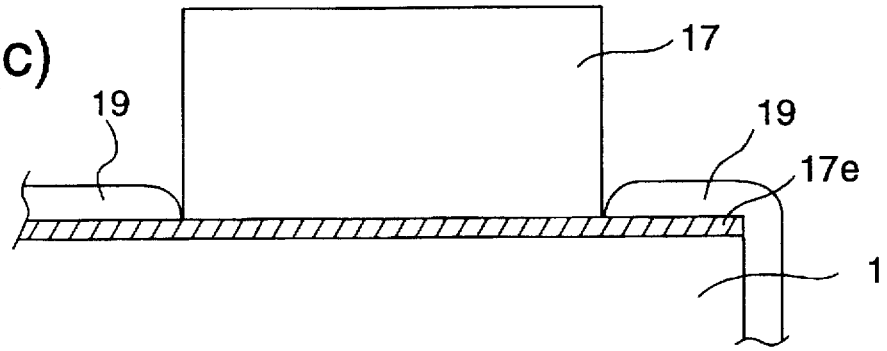

FIG. 4 is a detailed partial cross section of the common electrode area in the above embodiment. FIG. 4(*a*) shows common electrode 17 formed in first substrate 1 on p-type silicon substrate 1*p* of, for example, boron doped to a predetermined concentration to the entire surface of the silicon. FIG. 4(*b*) shows common electrode 17 formed on n-type silicon substrate 1*n* of, for example, phosphorus doped to a predetermined concentration to the entire surface of the silicon. 17*b* and 17*d* are a first layer of Cr or Ti; 17*a* and 17*c* are a second layer of Au, Rh, or Pt; and 19 is an insulation layer of an oxide film formed on the surface other than where common electrode 17 is formed on first substrate 1.

When the semiconductor substrate is a p-type semiconductor, ohmic contact is formed in the contact area for the above reasons when the metal is Au, Rh, or Pt, and a rectifying contact is formed with Cr or Ti. Thus, it is preferable to contact a metal of Au, Rh, or Pt directly to the semiconductor substrate, but the adhesion of these metals to, for example, a Si or other semiconductor is poor, and mechanical strength sufficient for an electrode cannot be retained. Conversely, Cr and Ti have good adhesion with Si and other semiconductors and metals of Au, Rh, or Pt, and are therefore used as an intermediate layer between the semiconductor substrate and these metals, but exhibit properties of a rectifying contact in the contact with the semiconductor.

In this embodiment as shown in FIG. 4(*a*), by forming first layer 17*b* on a p-type semiconductor substrate as a thin film with a thickness on the level of 50~150 Å, and forming second layer 17*a* on first layer 17*b* as a metallic film with a thickness on the level of 1000 Å, the effects of the rectifying contact produced by contact between the first layer 17b formed from Cr or Ti and the semiconductor substrate 1 can be reduced as much as possible. Namely, as shown in FIG. 4(*a*), the first layer 17b having 50~150 Å thickness is not uniform, many pores 18 are formed resulting in a so-called porous state, and the material of second layer 17a penetrates to this area, forming an ohmic contact. When the thickness of first layer 17b is 50~150 Å, mechanical strength sufficient for an electrode can be retained, and sufficient ohmic contact can also be obtained.

On the other hand, when the semiconductor substrate is an n-type semiconductor, a rectifying contact is formed in the contact area when the metal is Au, Rh, or Pt, and an ohmic contact is formed with Cr or Ti. In this case, as shown in FIG. 4(*b*), if the thickness of the first layer is 300 Å or greater, pores 18 shown in FIG. 4(*a*) are not formed, n-type silicon substrate 1n forms an ohmic contact with first layer 17d of Cr or Ti, mechanical strength sufficient for an electrode can be retained, and sufficient ohmic contact can also be obtained.

FIG. 4(*c*) shows an electrode formed by doping high concentration boron (B) to the surface on p-type silicon substrate. Common electrode 17 is same as the electrode structure shown in FIG. 4(*a*), and is formed on a high concentration boron layer 17e.

Because the surface barrier formed between high concentration layer 17e and the common electrode is a thin potential barrier, a good ohmic electrode can be formed because charges pass freely due to the tunnel effect. The same effect can be obtained by doping high concentration phosphorus (P) to the surface in which common electrode 17 is formed in the electrode structure shown in FIG. 4(*b*).

Figure 5:
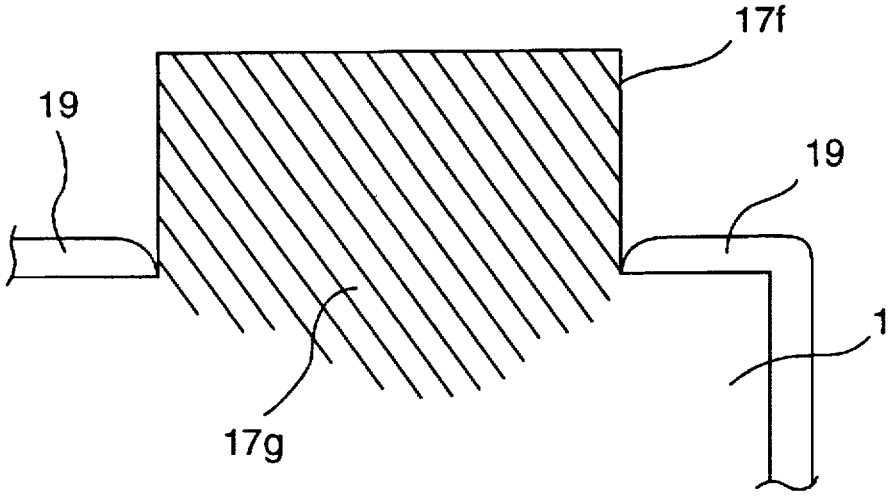
FIG. 5 is a detailed partial cross section of an alternative embodiment of the common electrode area in the above embodiment.

FIG. 5 is a detailed partial cross section of an alternative embodiment of the common electrode area in the above embodiment. With respect to common electrode 17, Al or Sn or In is vapor deposited to approximately 1000 Å in that part of insulation layer 19, which was formed over the entire surface of semiconductor substrate 1, removed to dispose common electrode 17, and is then heated to accomplish the thermal diffusion whereby these metals penetrate semiconductor substrate 1. As a result, contact 17f of common electrode 17 and semiconductor substrate 1 do not have a clear boundary surface as does the two-layer common electrode described above, and an ohmic contact can be obtained because a continuous connection through which the Al, Sn, or In concentration changes gradually results. In this case, Al and In can be applied with a p-type semiconductor substrate 1, and Sn can be applied with either a p-type or n-type semiconductor substrate 1.

To function as a terminal for connecting the drive circuit, electrodes of a two-layer structure using metals of Au, Rh, or Pt are preferable for the second layers 17c and 17d described above because the surface of single layer electrodes using Al are easily oxidized, and an insulation layer is thus easily formed on the surface.

Described next is the effect on ink jet head drive when a resistance or capacitance is formed by contact between common electrode 17 and semiconductor substrate 1.

Figure 6:
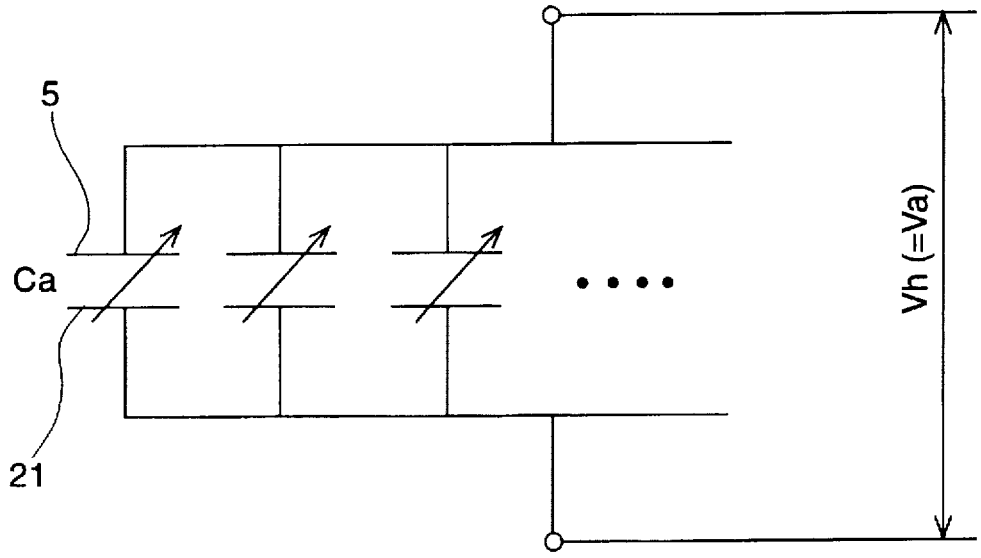
FIGS. 6(*a*) and 6(*b*) show an equivalent circuit diagram during ink jet head drive considering contact between the common electrode and the semiconductor substrate.
Figure 6:
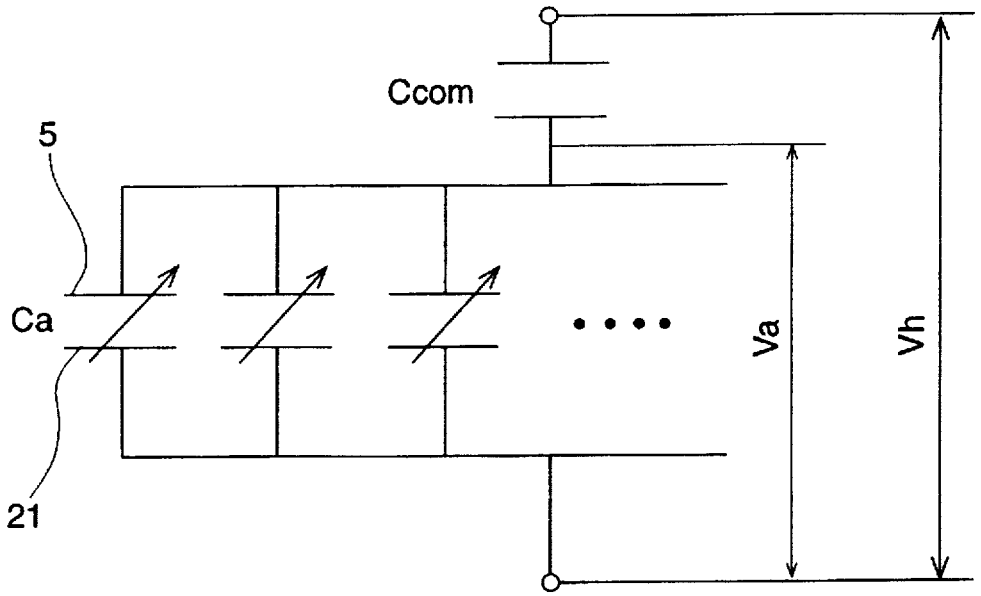

FIG. 6(*a*) is an equivalent circuit diagram when plural diaphragms 5 are driven with a resistance or capacitance not formed in the contact between common electrode 17 and semiconductor substrate 1; and FIG. 6(*b*) is an equivalent circuit diagram when plural diaphragms 5 are driven with a capacitance formed in the contact between common electrode 17 and semiconductor substrate 1.

Here, Ca is an actuator formed by each diaphragm 5 and individual electrodes 21, and functions as a variable capacitor because the distance between the diaphragm 5 and individual electrode 21 changes when driven. Ccom is a capacitance created by the formation of a depletion layer described above without ohmic contact being formed in the contact between semiconductor substrate 1 and common electrode 17; Vh is the power supply voltage applied to the ink jet head; and Va is the voltage applied to each actuator; Vh is equal to Va when Ccom does not exist (a).

When Ccom exists (b), the voltage Va applied to each actuator is expressed by the following equation.

$$Va=Vh\cdot Ccom/(nCa+Ccom) \quad \text{[equation 1]}$$

where 'n' is the number of drive nozzles. When capacitance Ccom of the common electrode is low compared to the actuator capacitance Ca, the drive voltage Va actually applied to each actuator decreases inversely proportional to the number of drive nozzles. Therefore, the ink ejection speed decreases inversely proportional to the number of drive nozzles, the actuators disposed in parallel affect each other, and become a factor in crosstalk adversely affecting the ink ejection.

Figure 7:
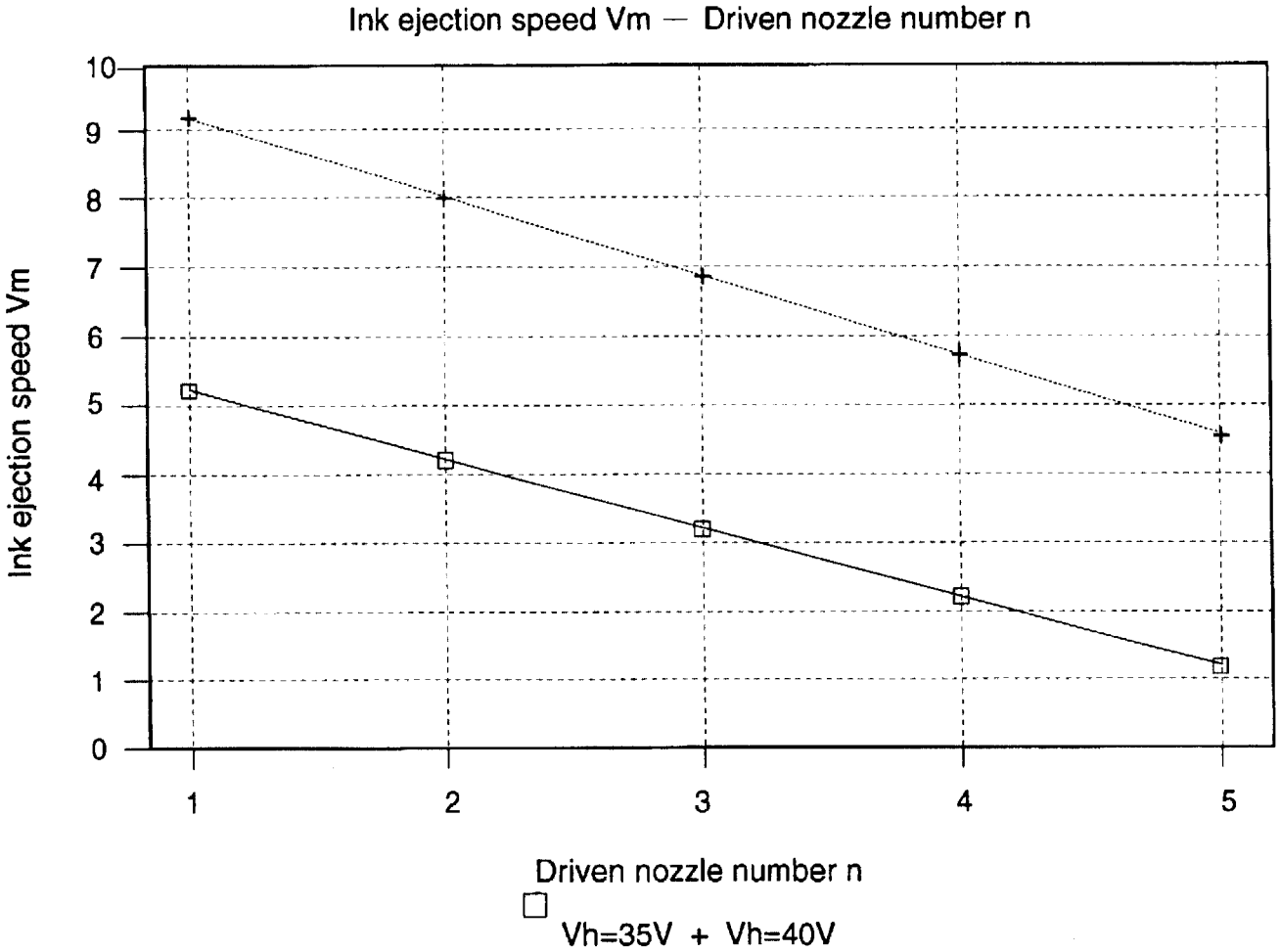
FIG. 7 is a characteristics graph showing the relationship between ink ejection speed Vm and drive nozzles n.

FIG. 7 is a graph of the relationship between the ink ejection speed Vm and drive nozzles 'n' calculated according to equation 1 after experimentally obtaining the drive voltage and ink ejection speed. Here Ccom is 608.2 pF and Ca is 277 pF; both values were calculated based on the measured value, and the ink jet head used for measurement and calculations was presumed to have been intentionally provided with capacitance in the common electrode area. The drive voltage Vh was presumed to be 35 V and 45 V.

If the ink ejection speed Vm is low, the ink volume per one ejection is reduced proportionally to the ink ejection speed Vm, resulting in a smaller dot diameter on the recording medium, insufficient overall density in the recorded image, and thus a low contrast image. Furthermore, the ink droplets are ejected not as a single spherical drop, but in a string-like succession of plural droplets. Thus, if ink ejection speed Vm is low, the droplets following (satellite droplets) the first droplet will be delayed reaching the recording medium, the dot diameter on the recording medium changes, and the resulting image will be lacking in overall sharpness. This tendency toward poor definition increases as the scanning speed of head 10 increases, and a low ink ejection speed Vm is therefore undesirable if the printing speed is to be increased; the ink ejection speed Vm is therefore preferably at least 10 m/sec. or greater.

As shown in FIG. 7, when an added capacitance appears in the common electrode area, the ink ejection speed decreases inversely proportional to the number of driven nozzles, and good print quality cannot be expected in a multiple nozzle ink jet head.

The case in which a capacitance occurs in the connection of semiconductor substrate 1 and common electrode 17 was described above, but when a resistance occurs in the same area, the phenomenon of the ink ejection speed decreasing according to the number of driven nozzles similarly occurs, and problems result.

Next, the method of manufacturing the ink jet head of the present invention is described in detail below based on the following embodiment.

Figure 8:
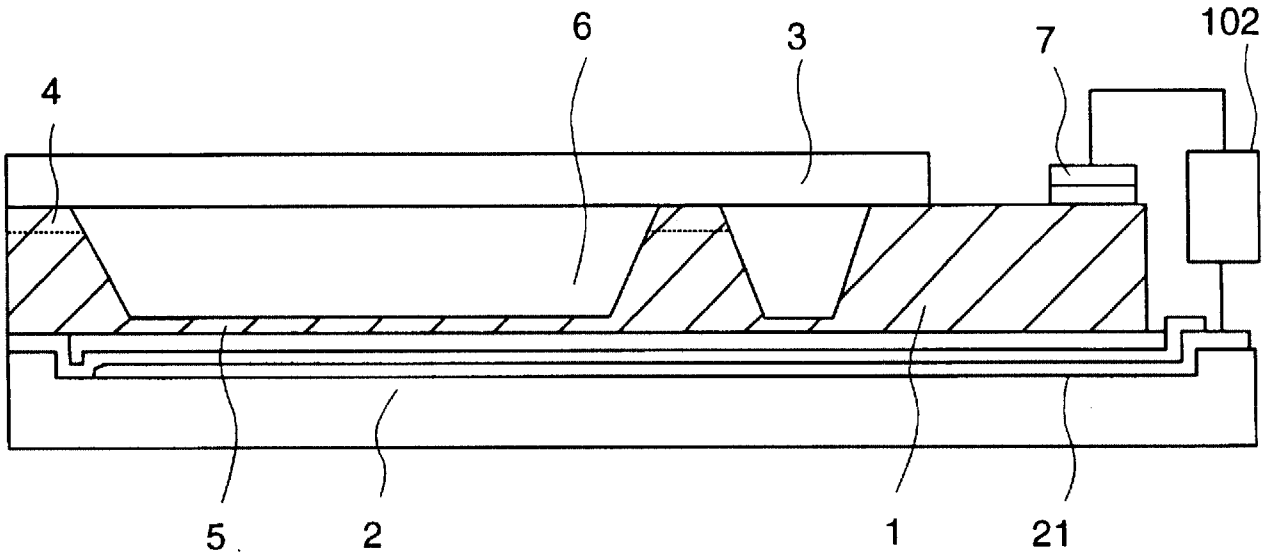
FIG. 8 is a side cross section of an ink jet head according to another embodiment of the present invention.
Figure 9A:
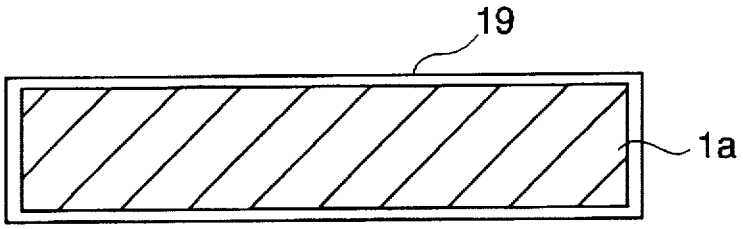
FIGS. 9(*a*)–9(*d*) show a manufacturing process diagram for the substrate of the ink jet head shown in FIG. 8.
Figure 9B:
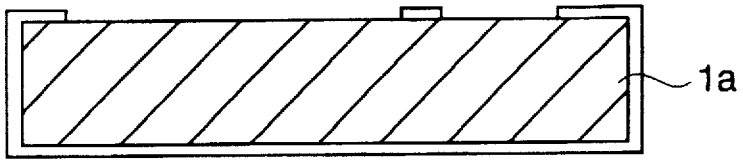
Figure 9C:
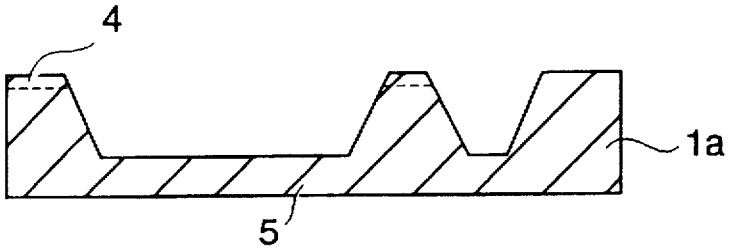
Figure 9D:
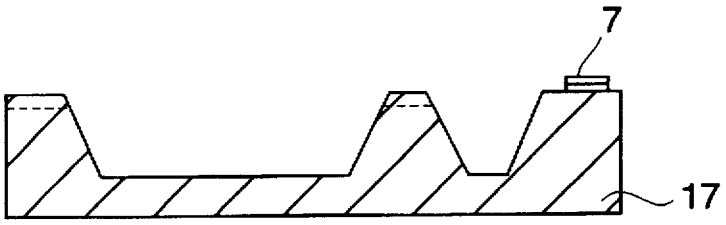

FIG. 8 is a cross section of the final shape of the ink jet head obtained by the manufacturing method of the present embodiment. As shown in FIG. 8, the ink jet head of the present embodiment comprises a first substrate 1 in which are formed nozzles 4 from which ink is ejected, ejection chambers 6 for pressurizing the ink, diaphragms 5, and common electrode 17; a second substrate 2 in which individual electrodes 21 are formed; and a third substrate 3.

First substrate 1 is a p-type single crystal Si substrate with a crystal face orientation of (100); nozzles 4 and diaphragm 5 are formed by etching away the unneeded parts of the Si substrate. In this embodiment, formation of the nozzles and diaphragm was accomplished by Si anistropic etching using an alkaline solution. As is common knowledge, the etching speed can vary greatly between crystal faces when single crystal Si is etched with an alkaline such as aqueous potassium hydroxide or hydrazine, and anistropic etching is therefore possible. Specifically, because the etching speed of crystal face (111) is slowest, a structure in which face (111) remains as a smooth face is obtained as etching progresses.

The manufacturing process of first substrate 1 is described with reference to FIG. 9. $SiO_2$ film 19, which is an etching resistant material, is formed by a thermal oxidation method on both sides of 200 micron thick Si substrate 1*a* (a p-type semiconductor substrate with 20½-cm resistivity) (FIG. 9(*a*)). Next, a photoresist pattern (not shown in the figures) equivalent to the shape of nozzles 4 and ejection chambers 6, etc., is formed over $SiO_2$ film 19, and the unnecessary parts of $SiO_2$ film 19 are removed by a hydrofluoric acid etching solution (FIG. 9(*b*)). Next, silicon etching using an aqueous solution of potassium hydroxide containing isopropyl alcohol is accomplished. As described above, face (111) appears where the silicon is etched, and the size of face (111) is proportional to the etching depth. In the etching area of nozzles 4, the faces (111) that appeared from both sides are in the end mixed together, and further etching virtually ceases to advance. In other words, nozzles 4 are formed with a cross sectional shape uniformly determined by the size of the photoresist pattern corresponding to nozzles 4.

Diaphragm 5 is similarly comprised of a shape determined by the size of the photoresist pattern in the area corresponding to diaphragm 5, but in this case the size of the photoresist pattern is designed such that the surface of diaphragm 5 becomes the same face (100) as the surface of Si substrate 1*a*. In the present embodiment, the thickness of diaphragm 5 is set to 30 microns and the width to 500 microns with consideration to the ejection characteristics of the ink jet head. Faces (100) and (111) of Si single crystals intersect at 54.7°; from this, the width of the photoresist pattern corresponding to diaphragm 5 is set to 730 microns. In the etching process, Si substrate 1*a* is etched 170 microns, all of $SiO_2$ film 19, the etching mask, is removed, and nozzles 4 and diaphragm 5 are obtained in the desired shape (FIG. 9(*c*)).

Common electrode 17 is formed next. A photoresist pattern (not shown in the figures) in which the spaces correspond to the shape of common electrode 17 is formed on Si substrate 1*a;* a two-layer film of Cr and Au (Cr, 0.1 micron; Au, 0.1 micron) is formed on the photoresist pattern using a sputtering apparatus; and Si substrate 1*a* is then immersed in acetone and ultrasonic vibration is applied to remove the photoresist pattern and the Cr-Au two-layer film only where it accumulated on the photoresist pattern. The two-layer film becomes common electrode 17 (FIG. 9(*d*)).

Another method of forming common electrode 17 is to form the Cr-Au two-layer film directly on Si substrate 1*a*, and then selectively remove the unnecessary parts of the Cr-Au two-layer film.

First substrate 1 is thus formed as a result of the above process.

The manufacturing process of second substrate 2 is described next with reference to FIG. 10. A photoresist pattern (not shown in the figures) corresponding to the shape of gap portion 83 between diaphragm 5 and individual electrode 21 disposed in opposition to diaphragm 5 is formed on borosilicate glass substrate 2*a;* Cr-Au two-layer film 85 is formed next by sputtering; and glass substrate 2*a* is then immersed in acetone and ultrasonic vibration is applied to remove the photoresist pattern and the Cr-Au two-layer film 85 only where it accumulated on the photoresist pattern. The remaining Cr-Au two-layer film 85 is used as the etching mask for forming gap member 83 by etching (FIG. 10(*a*)).

Figure 10:
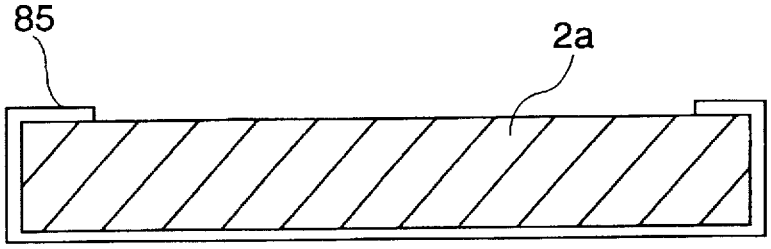
FIGS. 10(*a*)–10(*d*) show a manufacturing process diagram for the substrate of the ink jet head shown in FIG. 8.
Figure 10:
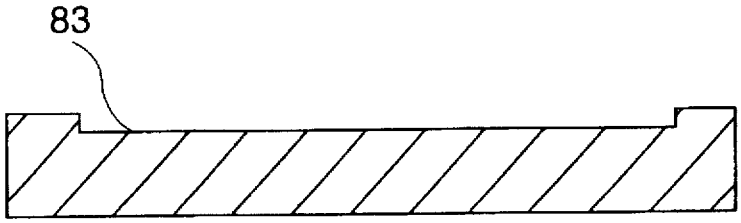
Figure 10:
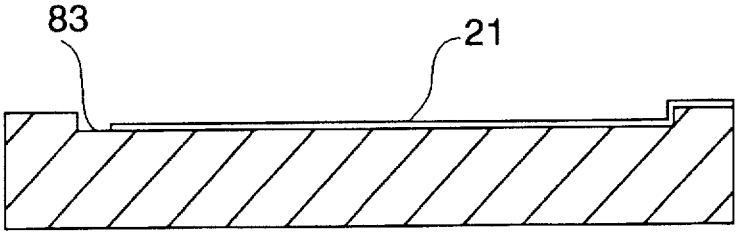
Figure 10:
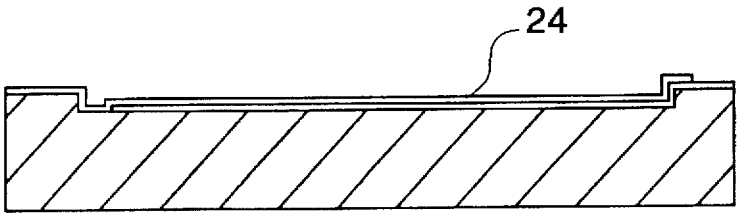

Next, glass substrate 2*a* is etched in a hydrofluoric acid etching solution to form gap portion 83 0.35 microns deep, and Cr-Au two-layer film 85, which is the etching mask, is removed in aqua regia (FIG. 10(*b*)).

Next, a photoresist pattern (not shown in the figures) in which the spaces correspond to the shape of individual electrodes 21 is formed on glass substrate 2*a;* a 0.15 micron thick Al film is then formed by vacuum deposition on the photoresist pattern; glass substrate 2*a* is then immersed in acetone and ultrasonic vibration is applied to remove the photoresist pattern and the Al film only where it accumulated on the photoresist pattern. The residual Al film becomes individual electrodes 21 (FIG. 10(*c*)).

Finally, a borosilicate glass thin film 24 is formed as a protective film by sputtering in the places corresponding to diaphragm 5 on glass substrate 2*a* to obtain second substrate 2 (FIG. 10(*d*)).

First substrate 1 and second substrate 2 manufactured by the above processes are then bonded by an anodic bonding method. The bonding process is as described below. First, Si substrate 1*a* and glass substrate 2*a* are washed and then dried; the matching patterns of Si substrate 1*a* and borosilicate glass substrate 2*a* are then positioned, and the substrates are placed together. Both substrates are then heated to 300° C. on a hot plate, and a 500-V DC voltage is then applied for 10 minutes with Si substrate 1*a* as the positive and glass substrate 2*a* as the negative to accomplish bonding.

Bonding of Si substrate 1*a* and third substrate 3 is accomplished next. In the present embodiment, third substrate 3 is of borosilicate glass identical to second substrate 2, and the bonding method is anodic bonding as described above.

The results of printing tests conducted after connecting drive circuit 102 to common electrode 17, and individual electrodes 21 of the ink jet head formed by the series of processes of the present embodiment are described below.

Figure 11:
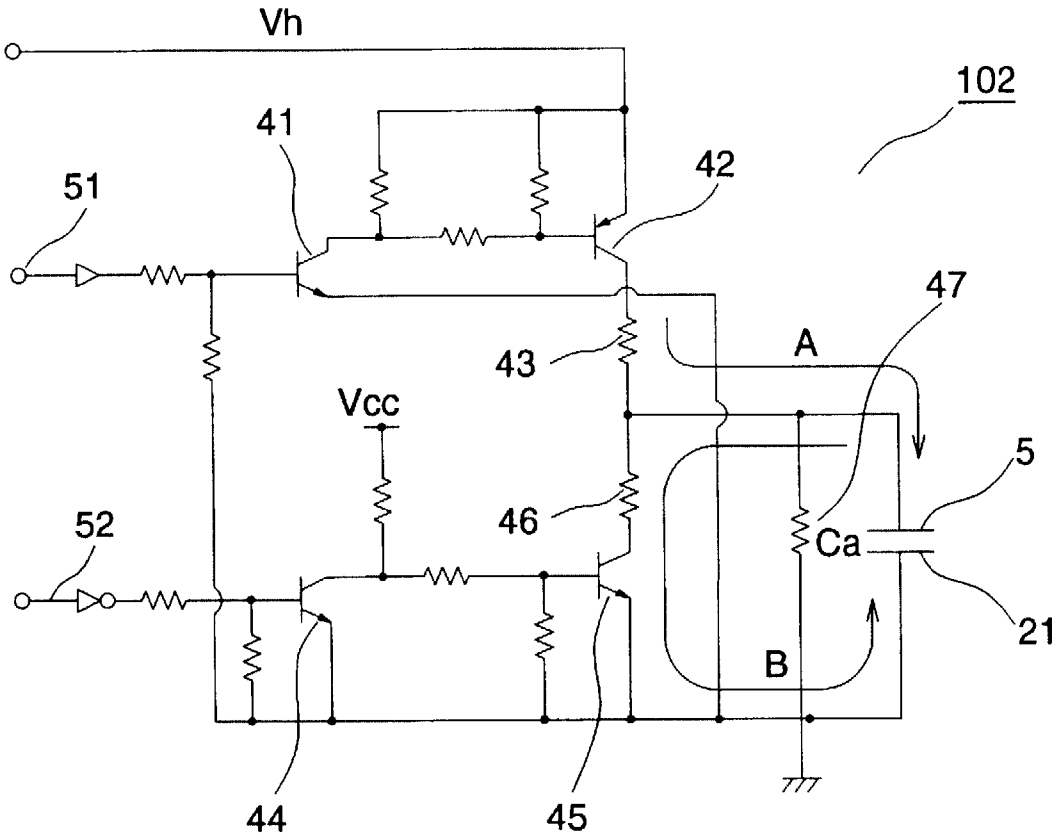
FIG. 11 is a figure showing the configuration of the control drive circuit of the above embodiment.

FIG. 11 shows the configuration of ink jet head drive circuit 102. This drive circuit 102 comprises transistors 41, 42, 44, 45, etc. as shown in the figure. In the standby state, both transistors 42 and 45 are OFF, terminal voltage Vh is not applied to capacitor Ca formed by diaphragm 5 and individual electrode 21, and the drive voltage is therefore not applied to diaphragm 5 and individual electrode 21. As a result, diaphragm 5 does not displace, and absolutely no pressure is applied to the ink in ejection chamber 6. Next, because transistor 41 and transistor 42 become ON at the signal rise when charge signal 51 becomes ON, terminal voltage Vh is applied to capacitor Ca, and the drive voltage Va (Va=Vh) is applied between diaphragm 5 and individual electrode 21. Current therefore flows in the direction of arrow A, and diaphragm 5 is pulled to deflect towards individual electrode 21 by the electrostatic force working between diaphragm 5 and individual electrode 21 due to the charge charged therebetween. As a result, the volume of ejection chamber 6 increases, and ink is drawn in.

Next, when charge signal 51 becomes OFF and discharge signal 52 becomes ON, transistors 41 and 42 become off; charging of capacitor Ca therefore stops, and charging between diaphragm 5 and individual electrode 21 thereby stops. In addition, transistor 44 becomes OFF, and transistor 45 thereby becomes ON. The charge accumulated to capacitor Ca between diaphragm 5 and individual electrode 21 is then discharged in the direction of arrow B through resistance 46 by transistor 45 becoming ON. In the figure, because resistance 46 is set significantly lower than resistance 43 and the time constant of discharging is low, discharge is accomplished in a sufficiently short time compared with the charge time. At this time, diaphragm 5 is released from the electrostatic force at once, thus returns to the standby position by the inherent rigidity of diaphragm 5 and suddenly presses ejection chamber 6, causing ink droplet 104 to be ejected from nozzle 4 by the pressure created in ejection chamber 6. It is to be noted that in the present embodiment it is presumed that first substrate 1 is a p-type semiconductor substrate; when an n-type semiconductor substrate is used as the substrate, the connections between drive circuit 102 and ink jet head 10 must be made the reverse of those for a p-type semiconductor.

Figure 12:
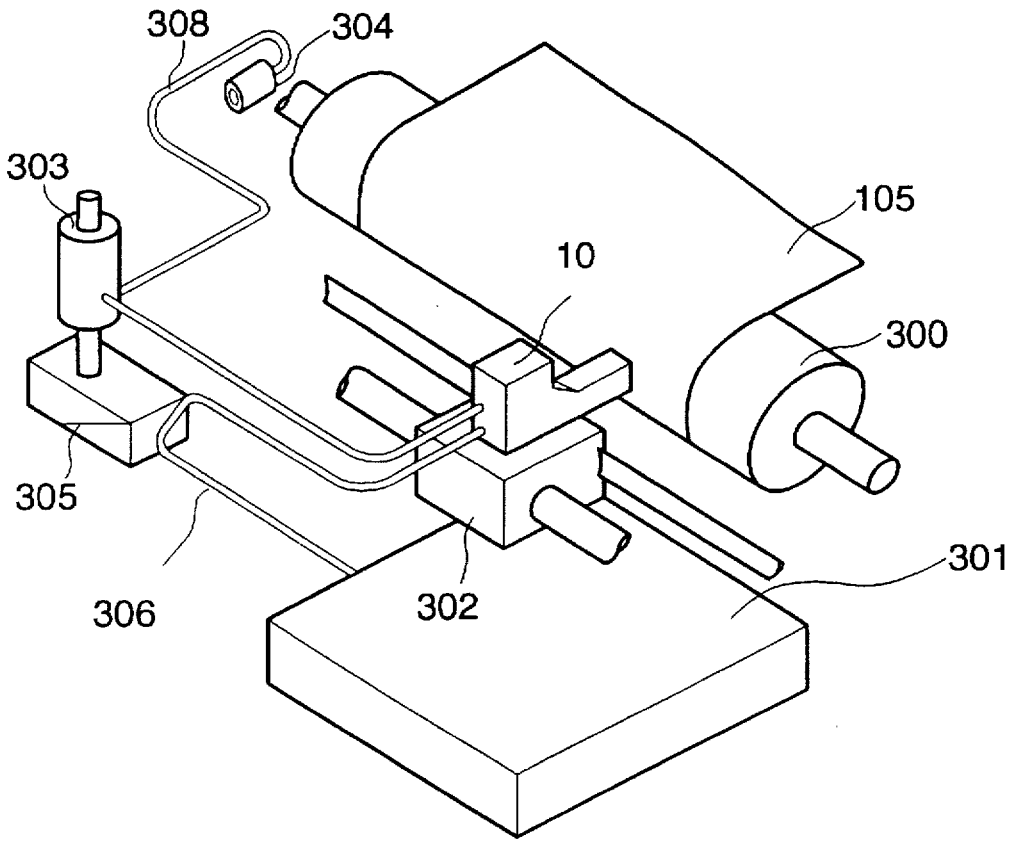
FIG. 12 is a summary view of a printer in which the ink jet head of the above embodiment is disposed.

FIG. 12 is a summary view of a printer comprising the above ink jet head 10. Platen 300 transports recording paper 105, and ink tank 301 stores the ink internally for supplying ink to ink jet head 10 through ink supply tube 306. Carriage 302 moves ink jet head 10 in the direction perpendicular to the transport direction of recording paper 105. Pump 303 functions to suction ink through cap 304 and waste ink recovery tube 308 for recovery to waste ink reservoir 305 when there is an ink eject defect or other problem in ink jet head 10.

In drive tests at a 40-V drive voltage using the circuit in FIG. 11 and the printer in FIG. 12, the frequency characteristics of the ink ejection speed and ink volume are in the ranges 7±0.3 m/sec. and $0.1\pm0.02\times10^{-6}$ ml/dot, respectively, to 8 kHz, flat characteristics are obtained to a high frequency, and suitability to high speed printing is clear.

A Cr-Au two-layer film is used as common electrode 17 in the present embodiment, but the same effect can be obtained using a metal obtaining an ohmic contact with a p-type Si substrate of a Ti-Pt two-layer film, Ti-Rh two-layer film, etc. In addition, when an n-type Si substrate is used as the first substrate, the same effects can be obtained if a metal such as Sn similarly obtaining an ohmic contact with the n-type Si substrate is used.

Next, tests are conducted with the ink jet head of the present embodiment concerning the effect on ink jet head drive of the resistance component contained in the drive circuit.

Figure 13:
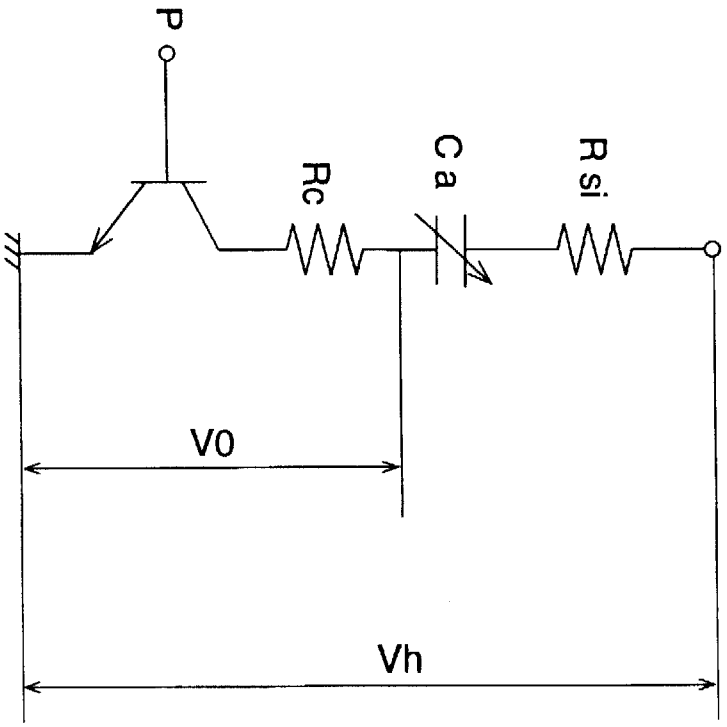
FIG. 13 is an equivalent circuit diagram of the drive circuit in the characteristics test of the ink jet head of the above embodiment.

FIG. 13 is an equivalent circuit diagram of the drive circuit used in these tests; Rsi is the resistance of silicon substrate 1 itself, and is a resistance equivalent to a 20½-cm resistivity; Ca is a capacitor formed by diaphragm 5 and individual electrode 21, and has a capacitance of approximately 300 pF when diaphragm 5 is not pulled to individual electrode 21. Rc is a resistance disposed in the drive circuit; comparative tests are conducted with a resistance of 1 k½ and 10 k½. It is to be noted that tests are conducted with drive voltage Vh fixed to 35 V, and a 3-kHz drive frequency signal input to signal input terminal P.

Figure 14:
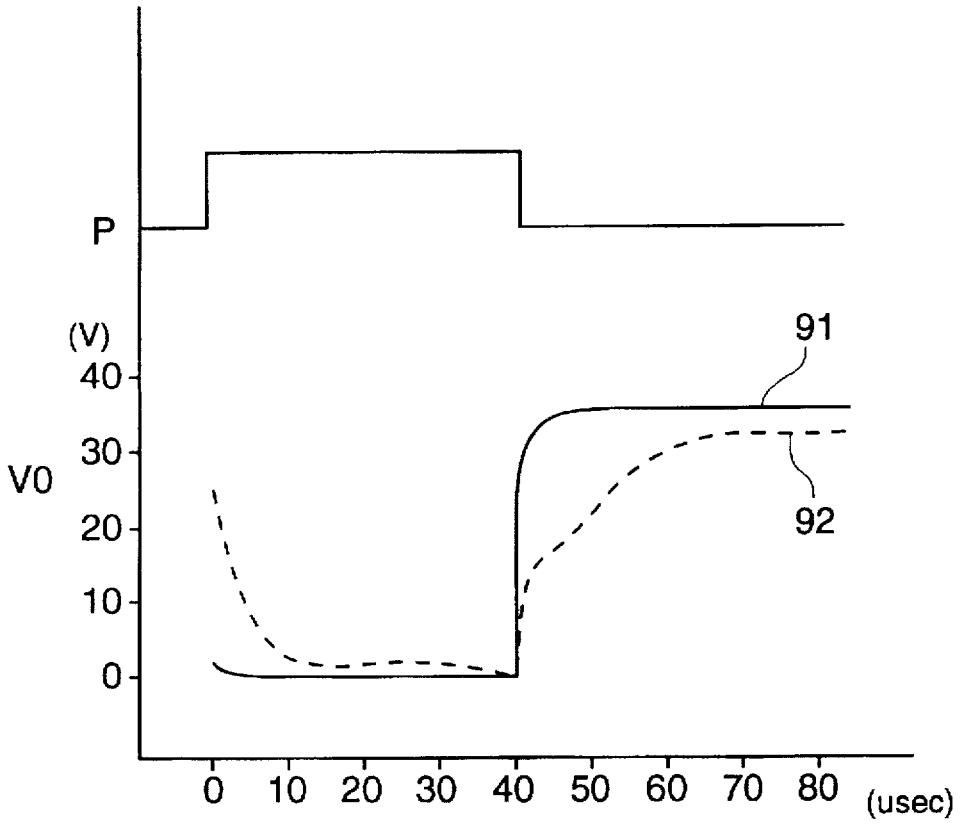
FIG. 14 is a characteristics graph obtained by observation using an oscilloscope of the drive wave of the above drive circuit.

FIG. 14 is a graph showing the wave form from oscilloscope observations of the drive wave Vo in the drive circuit in FIG. 13. Wave 91 is the drive wave when circuit resistance Rc is 1 k½; wave 92 is the drive wave when circuit resistance Rc is 10 k½. The time constant of wave 92 is greater than that of wave 91, and sufficient ink ejection speed could not be obtained in all nozzles with the ink jet head driven by wave 92. However, an ink ejection speed of 10 m/sec. or greater was obtained in substantially all nozzles with the ink jet head driven by wave 91. This difference is believed to occur because diaphragm 5 cannot be sufficiently pulled to individual electrode 21 because of the large time constant, but in any case it was determined that the resistance component connected in series to capacitor Ca greatly influences the ink jet head drive characteristics.

Therefore, sufficient ink ejection performance can be obtained if the resistivity of the silicon substrate is less than approximately 20½-cm with the ink jet head obtained by the present embodiment, but sufficient ink ejection performance is not obtained at approximately 30½-cm, and it is necessary to suppress the resistivity to 20½-cm or less; in addition, resistivity less than 20½-cm is preferable because the ink ejection characteristics extend to the high frequency side.

Next, a method of the invention for manufacturing particularly a high resolution ink jet head is described below in even greater detail.

Figure 15:
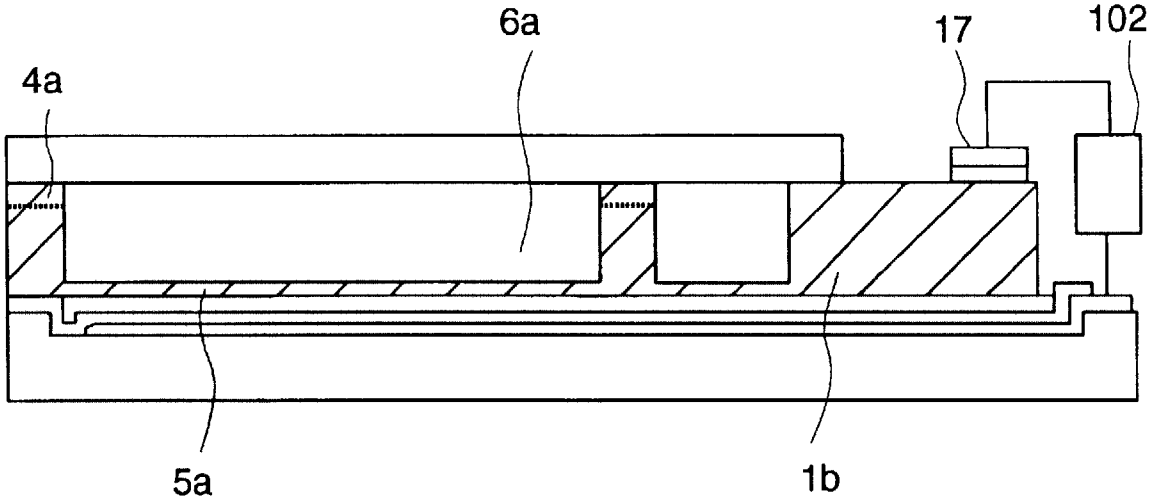
FIG. 15 is a side cross section of an ink jet head according to another embodiment of the present invention.

FIG. 15 is a cross section of an ink jet head according to an alternative embodiment of the invention. This ink jet head has basically the same construction as the ink jet head of the embodiment shown in FIG. 8. What differs is that the distance between adjacent pressure chambers is minimized in first substrate **1*b* in which nozzles 4*a* and pressure chamber 6*a* are formed using a single crystal Si substrate in which the crystal face is (110), and a silicon substrate with resistivity of 1½-cm is used as first substrate 1*b*** to form a high density ink jet head.

In a (110) Si substrate, face (111) intersects perpendicularly with the substrate surface. By structuring the shape of pressure chamber **6*a* surrounded by walls perpendicular to the substrate surface as shown in FIG. 15**, a structure with the shortest distance between adjacent pressure chambers, i.e., the highest density structure, can be obtained.

The pitch between pressure chambers and nozzles is 70 microns, i.e., 360 dpi (dots per inch), and the width of pressure chamber **6*a* is 50 microns in the present embodiment. The width of pressure chamber 6*a* and the width of diaphragm 5*a* are equal in the structure of the ink jet head according to the present embodiment. Based on the vibration characteristics of a thin plate 50 microns wide, the ideal thickness of diaphragm 5*a*** is 1 micron. Various methods are available for forming a 1 micron thick thin plate; the method used in the present embodiment was to dope the surface on which the thin panel of the Si substrate is formed with boron to a thickness of 1 micron and concentration of $1\times10^{20}$ ions/cm$^3$. The etching rate becomes extremely slow where there is such a high boron concentration when Si is etched with an alkali, and a structure wherein only the 1 micron thick boron-doped layer remains can be obtained.

Nozzles **4*a*** are likewise formed by anistropic etching using an alkaline.

Common electrode 17 is formed as in the ink jet head of the embodiment shown in FIG. 8, the second substrate and the third substrate are also formed as in the ink jet head of the embodiment shown in FIG. 8, and the ink jet head is likewise formed by the same processes.

In drive tests at a 40-V drive voltage using the circuit in FIG. 11 and the printer in FIG. 12, the frequency characteristics of the ink ejection speed and ink volume are in the ranges 10±0.4 m/sec. and $0.1\pm0.01\times10^{-6}$ ml/dot, respectively, to 9 kHz, flat characteristics are obtained to a high frequency, and a high speed, high density ink jet head is obtained.

It is to be noted that in designing a high resolution ink jet head such as this, it is the resistance of the semiconductor substrate in particular that becomes a problem.

For example, if a low resolution ink jet head of approximately 40 dpi is designed assuming the manufacturing method of the ink jet head of the embodiment using face (100) of the Si substrate shown in FIG. 8, and if a medium resolution ink jet head of approximately 180 dpi is designed assuming the manufacturing method of the ink jet head of the embodiment using face (110) of the Si substrate shown in FIG. 15, the cross sectional area of the diaphragm and walls of ejection chamber 6 left in the Si substrate after forming the ink channels by etching will be, in the approximately 180 dpi ink jet head, approximately 1/10 the cross sectional area of the approximately 40 dpi ink jet head per ejection chamber; and the actual resistance Rsi between common electrode 17 and diaphragm 5 will accordingly be approximately 10 times. However, because the area of individual electrode 21 is ½, the capacitance of capacitor Ca formed by diaphragm 5 and individual electrode 21 is also ½. Thus, when a Si substrate of the same resistivity is used as first substrate 1, the time constant RsioCa of the approximately 180 dpi medium resolution ink jet head will be 5 times the time constant of the approximately 40 dpi low resolution ink jet head.

It is therefore necessary to appropriately select the resistance of first substrate 1 according to the resolution: in a so-called low resolution ink jet head of approximately 30~100 dpi, the resistivity of first substrate 1 is preferably 20½-cm or less; in a so-called medium resolution ink jet head of approximately 150~250 dpi, the resistivity of first substrate 1 is preferably 4½-cm or less; and in a so-called high resolution ink jet head of approximately 300 dpi or greater, the resistivity of first substrate 1 is preferably 2½-cm or less.

Another manufacturing method for an ink jet head of the present invention is described in further detail based on the following embodiment.

The ink jet head of this embodiment uses a p-type Si substrate as the first substrate, and the area where the common electrode is formed on the Si substrate is characterized by being doped with high concentration boron.

As described above, with the drive method of the ink jet head of the present invention, because diaphragm 5 is deformed by the static electricity between diaphragm 5 and the individual electrode 21 disposed in opposition to diaphragm 5, it is necessary to achieve a high speed charge supply to diaphragm 5 in order to achieve high speed in the ink jet head. In other words, the Si substrate that is the support substrate of drive circuit 102 and diaphragm 5, and is also the charge path, must be connected to have the smallest possible contact resistance and no diode characteristic. Using a common electrode material having an ohmic contact with the Si substrate as in the ink jet head of the embodiment shown in FIG. 8 satisfies this requirement, but when even higher speed operation is required in the ink jet head, it is possible to lower resistance by doping the contact of the Si substrate with drive circuit 102 with an impurity.

In the present embodiment, boron ion implanting is accomplished on the surface of the Si substrate, which is the first substrate of the ink jet head of the embodiment shown in FIG. 15, on which common electrode 7*a* is formed. The conditions for ion implanting are as described below.

After implanting with an ion acceleration voltage of 120 keV and doping concentration of $5\times10^{16}/cm^2$, an annealing process is applied for one hour at 1000° C., achieving a volume density of boron in the Si substrate surface of $5\times10^{19}/cm^3$. Other than for formation of the common electrode, the other processes are accomplished identically to those of the ink jet head of the embodiment shown in FIG. 15 to manufacture the ink jet head.

In actual printing tests of the ink jet head of the present embodiment at a 40-V drive voltage using the circuit in FIG. 11 and the printer in FIG. 12, the frequency characteristics of the ink ejection speed and ink ejection volume are in the ranges $10\pm0.4$ m/sec. and $0.1\pm0.01\times10^{-6}$ ml/dot, respectively, to 12 kHz, flat characteristics are obtained to a high frequency, and a high speed, high density ink jet head is obtained.

In the present embodiment, the volume density of boron in the boron-doped part of the Si substrate was $5\times10^{19}/cm^3$; in principle, resistance is extremely low and the same effect is obtained if the volume density of boron in the doped part is $10^{19}$ or less. When an n-type Si substrate is used as the first substrate, the same effect can be obtained if a group V element impurity is similarly doped.

An alternative embodiment of the common electrode in an ink jet head according to the present invention is described based on the following embodiment.

Figure 16:
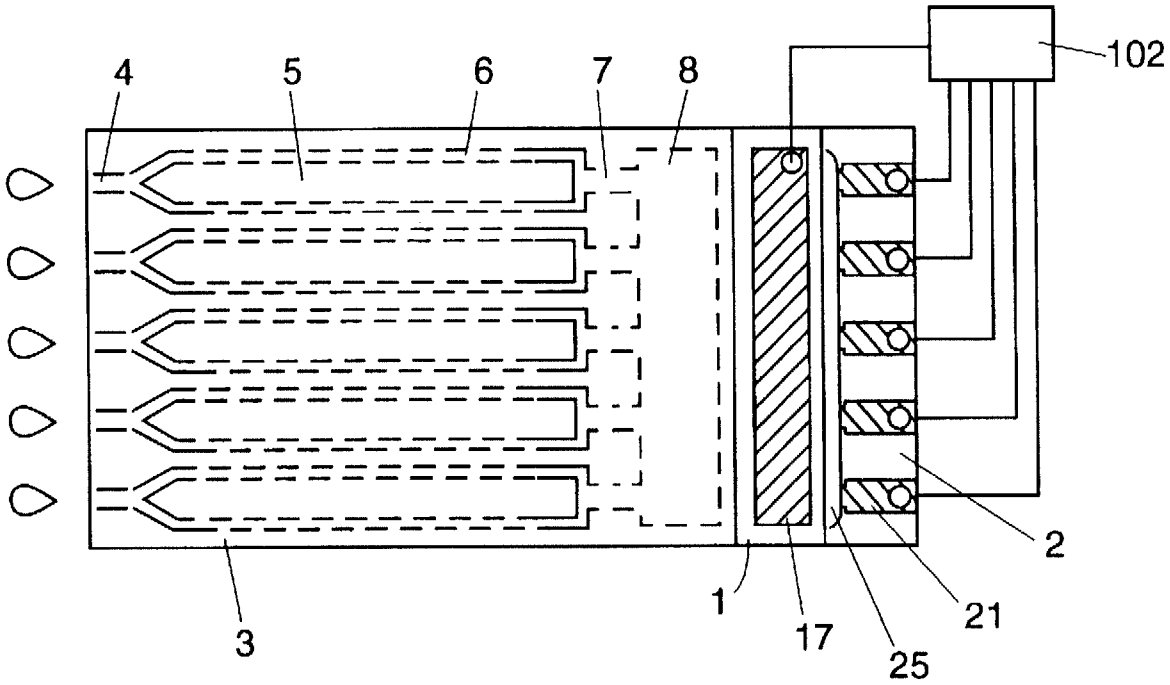
FIG. 16 is a plan view of an ink jet head according to another embodiment of the present invention.

A plan view of an ink jet head according to another embodiment of the present invention is shown in FIG. 16.

Common electrode 17 of a two-layer metallic coating of Cr and Au is disposed behind common ink cavity 8, wide in the direction in which ejection chambers 6 are arrayed and such that the distance from each diaphragm 5 to common electrode 17 is equal as a means of increasing the contact area and reducing the contact resistance with silicon substrate 1 as much as possible, reducing the distance of the silicon from diaphragm 5 to common electrode 17 as much as possible, and making the speed of the ink droplets and the ink ejection volume from each of nozzles 4 as uniform as possible.

Because the distance from common electrode 17 to each of diaphragms 5 is equal in this embodiment, the resistance between each of diaphragms 5 and the common electrode when driven can be equalized, and it is thereby possible to prevent the ink ejection characteristics of each of nozzles 4 from becoming uneven as a result of the nonuniformity of the resistance.

An alternative embodiment of the common electrode in an ink jet head according to the present invention is described based on the following embodiment.

Figure 17:
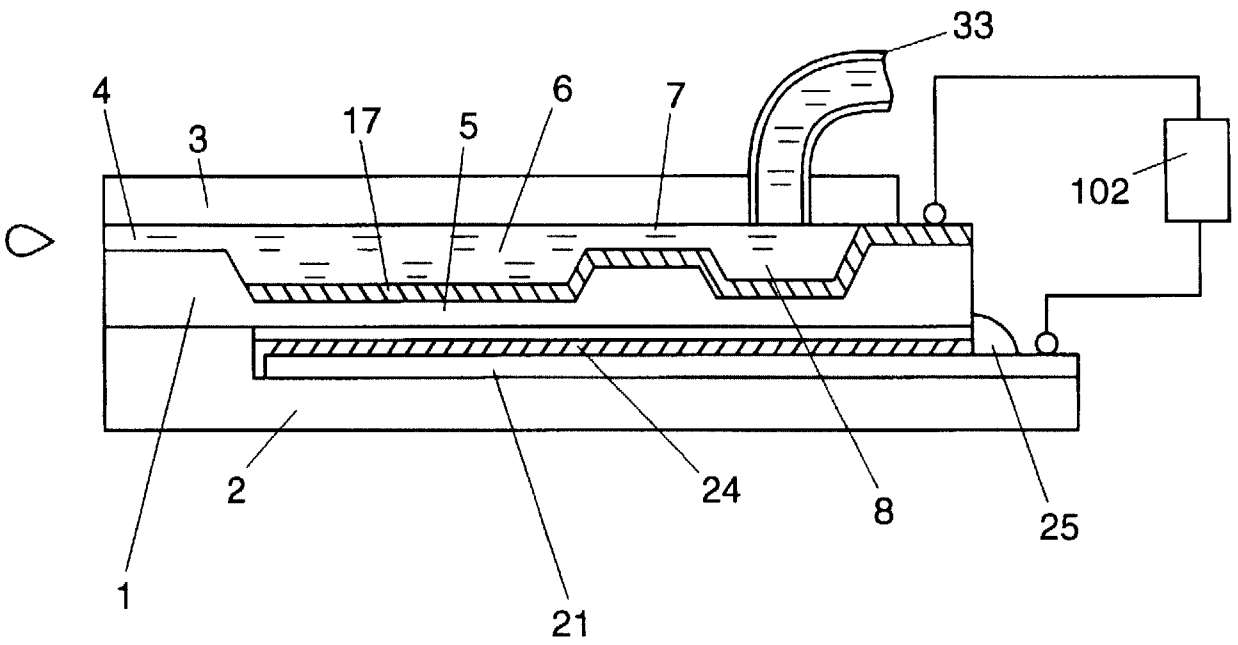
FIG. 17 is a side cross section of an ink jet head according to another embodiment of the present invention.

A cross section of an ink jet head according to another embodiment of the present invention is shown in FIG. 17.

Common electrode 17 is formed with the two-layer metallic coating of Cr and Au disposed to the top of diaphragm 5. Common electrode 17 contacts the ink, but common electrode 17 will not electrolytically corrode if all of the ink reaches the same potential. The overall electrical resistance can be reduced because the contact area of common electrode 17 and first substrate 1 can be further increased and the distance of charge movement in first substrate 1 can be minimized by means of this embodiment. This is particularly effective when a compact ink jet head is required and the common electrode cannot be sufficiently achieved.

Each of the above embodiments has been described using primarily silicon as the semiconductor of first substrate 1, but semiconductors other than silicon can also be used as the material of the first substrate, and the same operation and effects can be obtained using germanium (Ge), gallium arsenide (GaAs), or indium tin (InSn). Particularly when Ge is used, controlling the impurity concentration is simple and a substrate with uniform resistance can be produced.

APPLICATIONS IN INDUSTRY

As described above, an ink jet head according to the present invention is suitable as the recording means of an ink jet recording apparatus, and is ideal as the recording means of a compact printer which can be efficiently driven particularly at a low power supply voltage, and from which a high printing speed and high print quality are expected.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed:

1. An ink jet head, comprising:

a semiconductor substrate in which are formed ejection chambers including nozzles and diaphragms associated with respective ejection chambers, said semiconductor substrate including a first surface and a second surface on the opposite side of said first surface, said semiconductor substrate including a common electrode comprising a metallic coating which includes a first layer formed on at least part of said first surface and a second layer formed on said first layer, said first layer being made of a material selected from a group consisting of chrome (Cr) and titanium (Ti), said second layer being made of a material selected from a group consisting of gold (Au), rhodium (Rh), and platinum (Pt); and a substrate laminated to said second surface of said semiconductor substrate, said substrate including electrodes formed thereon, each electrode being disposed in opposition to a corresponding diaphragm with a gap therebetween;

wherein each of said diaphragms is deformable by an electrostatic force produced by applying an electrical pulse between said common electrode of said semiconductor substrate and a corresponding electrode to thereby eject ink droplets via a corresponding nozzle.

2. The ink jet head of claim 1 wherein said semiconductor substrate is of a p-type, and said first layer of said metallic coating has a thickness of between 50 to 150 Å.

3. The ink jet head of claim 1 wherein said semiconductor substrate is of an n-type, and said first layer of said metallic coating has a thickness not less than 300 Å.

4. The ink jet head of claim 1 wherein the semiconductor substrate is of a p-type, and a group III element is doped to at least that part of said first surface of said semiconductor substrate where the metallic coating is formed.

5. The ink jet head of claim 4 wherein the group III element has a volume density not less than $10^{19}/cm^3$.

6. The ink jet head of claim 1 wherein the semiconductor substrate is of an n-type, and a group V element is doped to at least that part of said first surface of said semiconductor substrate where the metallic coating is formed.

7. The ink jet head of claim 6 wherein the group V element has a volume density not less than $10^{19}/cm^3$.

8. The ink jet head of claim 1 wherein said metallic coating is equidistant to each of said diaphragms.

9. An ink jet head, comprising:

a semiconductor substrate in which are formed ejection chambers including nozzles and diaphragms associated with respective ejection chambers, said semiconductor substrate including a first surface and a second surface on the opposite side of said first surface, said semiconductor substrate including a common electrode comprising a metallic coating formed on at least part of said first surface, said metallic coating being made of a material selected from a group consisting of aluminum (Al), tin (Sn) and indium (In); and a substrate laminated to said second surface of said semiconductor substrate, said substrate including electrodes formed thereon, each electrode being disposed in opposition to a corresponding diaphragm with a gap therebetween;

wherein each of said diaphragms is deformable by an electrostatic force produced by applying an electrical pulse between said common electrode of said semiconductor substrate and a corresponding electrode to thereby eject ink droplets via a corresponding nozzle.

10. The ink jet head of claim 9 wherein said semiconductor substrate is of a p-type, and a group III element is doped to at least that part of said first surface of said semiconductor substrate where the metallic coating is formed.

11. The ink jet head of claim 10 wherein the group III element has a volume density not less than $10^{19}/cm^3$.

12. The ink jet head of claim 9 wherein said semiconductor substrate is of an n-type, and a group V element is doped to at least that part of said first surface of said semiconductor substrate where the metallic coating is formed.

13. The ink jet head of claim 12 wherein the group V element has a volume density not less than $10^{19}/cm^3$.

14. The ink jet head of claim 9 wherein said metallic coating is formed equidistant to each of said diaphragms.

15. An ink jet head, comprising:

a semiconductor substrate in which are formed ejection chambers including nozzles and diaphragms associated with respective ejection chambers, said semiconductor substrate having an resistivity not greater than 20 ohm-cm; and a substrate laminated to said second surface of said semiconductor substrate, said substrate including electrodes formed thereon, each electrode being disposed in opposition to a corresponding diaphragm with a gap therebetween;

wherein each of said diaphragms is deformable by an electrostatic force produced by applying an electrical pulse between said common electrode of said semiconductor substrate and a corresponding electrode to thereby eject ink droplets via a corresponding nozzle.

* * * * *